US011071885B2

(12) United States Patent
Hadley et al.

(10) Patent No.: US 11,071,885 B2
(45) Date of Patent: Jul. 27, 2021

(54) MASSAGE ROLLER AND CONTAINER

(71) Applicants: Bryant Hadley, Boulder, CO (US); Ethan Cobb, Davenport, IA (US)

(72) Inventors: Bryant Hadley, Boulder, CO (US); Ethan Cobb, Davenport, IA (US)

( * ) Notice: Subject to any disclaimer, the term of this patent is extended or adjusted under 35 U.S.C. 154(b) by 0 days.

(21) Appl. No.: 17/136,689

(22) Filed: Dec. 29, 2020

(65) Prior Publication Data

US 2021/0197011 A1 Jul. 1, 2021

Related U.S. Application Data

(60) Provisional application No. 62/954,629, filed on Dec. 29, 2019.

(51) Int. Cl.

| | |
|---|---|
| ***A63B 21/00*** | (2006.01) |
| ***A45F 3/14*** | (2006.01) |
| ***A61H 15/00*** | (2006.01) |
| ***A63B 23/00*** | (2006.01) |

(52) U.S. Cl.

CPC ..... *A63B 21/4037* (2015.10); *A45F 3/14* (2013.01); *A45F 2003/142* (2013.01); *A61H 2015/0014* (2013.01); *A63B 2023/006* (2013.01)

(58) Field of Classification Search

CPC ..... A63B 21/4037; A63B 2023/006; A63B 21/4039; A63B 26/003; A63B 22/16; A45F 3/14; A45F 2003/142; A61H 2015/0014; A61H 1/0292; A61H 15/00; A61H 2205/086; A61H 2205/081; A61H 2205/062; A61H 2203/0443; A61H 2201/1695; A61H 2201/169; A61H 2201/168; A61H 2201/1623; A61H 2201/1261; A61H 2201/0161; A61H 2201/0157

See application file for complete search history.

(56) References Cited

U.S. PATENT DOCUMENTS

| | | | | | |
|---|---|---|---|---|---|
| 2,943,621 | A * | 7/1960 | Phillips | A61H 23/0218 | 601/57 |
| 4,643,302 | A * | 2/1987 | Baumgardner | A45C 3/00 | 190/105 |
| 4,948,303 | A * | 8/1990 | Good | B65G 51/06 | 406/184 |
| 5,040,691 | A * | 8/1991 | Hayes | B65D 50/061 | 215/216 |
| 5,114,012 | A * | 5/1992 | Mushinski | B65B 25/148 | 206/389 |
| 5,335,809 | A * | 8/1994 | Toida | A47J 41/0011 | 220/23.88 |
| 5,425,194 | A * | 6/1995 | Miller | A01K 97/08 | 206/315.11 |
| 5,554,102 | A * | 9/1996 | Chiou | A61H 15/0092 | 601/118 |
| 5,572,757 | A * | 11/1996 | O'Sullivan | A47C 7/46 | 297/284.5 |
| 5,637,065 | A * | 6/1997 | Chang | A63B 23/14 | 482/1 |

(Continued)

*Primary Examiner* — Garrett K Atkinson

(74) *Attorney, Agent, or Firm* — Christopher Mayle; Bold IP, PLLC

(57) ABSTRACT

A system and method for a container for exercise mats that operates as a massage roller which has a quick and easy to use closure and a carrying system that does not impede the self-myofascial release process and is used for carrying the container.

17 Claims, 8 Drawing Sheets

(56) References Cited

U.S. PATENT DOCUMENTS 5,655,677 A * 8/1997 Fratello ..... B65G 51/06 220/4.22
5,901,966 A * 5/1999 Valerino, Sr. ..... B65G 51/06 277/548
6,015,246 A * 1/2000 Yamane ..... B65G 51/06 406/184
6,450,333 B1 * 9/2002 McClenahan ..... A01K 97/08 190/104
6,672,807 B1 * 1/2004 McIntyre ..... G07F 19/201 406/180
D497,961 S * 11/2004 Rolfes ..... D21/662
7,108,646 B1 * 9/2006 Quick ..... A47D 13/08 482/132
7,112,178 B1 * 9/2006 Roozenburg ..... A61H 1/0266 601/121
D546,380 S * 7/2007 Juarez ..... D18/35
8,029,425 B2 * 10/2011 Bronston ..... A63B 71/0036 482/130
8,267,622 B1 * 9/2012 MacLean-Blevins ..... B65G 51/06 406/186
8,365,941 B2 * 2/2013 Mayer ..... B65D 1/06 220/259.3
8,556,837 B1 * 10/2013 Poirier ..... A61H 15/0092 601/46
8,784,287 B2 * 7/2014 Miller, Jr. ..... A63B 21/4049 482/132
8,926,482 B2 * 1/2015 Miller, Jr. ..... A63B 21/4049 482/132
9,005,146 B2 4/2015 Phillips
9,073,708 B2 * 7/2015 Miller ..... B65G 51/04
9,550,088 B2 * 1/2017 Coompol ..... A63B 21/0722
D785,103 S * 4/2017 Townsend ..... D21/662
9,616,313 B2 * 4/2017 Townsend ..... B65D 43/0206
9,961,987 B1 * 5/2018 Harper ..... A45F 3/14
D822,772 S * 7/2018 Jorgenson ..... D21/662
D839,025 S * 1/2019 Casta-Baez ..... D6/601
10,265,583 B1 * 4/2019 Zaffino ..... A63B 26/003
D872,198 S * 1/2020 Kim ..... D21/662
10,765,594 B2 * 9/2020 Sanchez ..... A61H 15/0092
10,799,013 B2 * 10/2020 Slovis ..... A45C 13/26
10,888,733 B2 * 1/2021 Earls ..... A63B 21/4039
11,013,658 B1 * 5/2021 Brawley ..... A63B 22/18
2008/0200851 A1 * 8/2008 Faussett ..... A61H 15/0092 601/119
2009/0057189 A1 * 3/2009 Silvenis ..... A61J 1/035 206/570
2011/0009248 A1 * 1/2011 Bronston ..... A63B 21/153 482/124
2012/0150082 A1 * 6/2012 Davis ..... A61H 1/0237 601/118
2012/0322633 A1 * 12/2012 Holman ..... A63B 21/4035 482/123
2012/0323151 A1 * 12/2012 Faussett ..... A61H 15/0092 601/119
2013/0178768 A1 * 7/2013 Dalebout ..... A61H 15/0092 601/46
2013/0261517 A1 * 10/2013 Rodgers ..... A61H 15/00 601/121
2013/0310234 A1 * 11/2013 Miller, Jr. ..... A63B 22/20 482/139
2015/0080774 A1 3/2015 Olaya
2016/0059063 A1 * 3/2016 Breibart ..... A63B 23/185 482/123
2017/0071817 A1 * 3/2017 Sanchez ..... A61H 15/0092
2017/0156479 A1 * 6/2017 Kwong ..... A45F 4/02
2018/0257832 A1 * 9/2018 Loeffler ..... B65D 85/07
2018/0326254 A1 * 11/2018 Earls ..... A63B 26/003
2018/0353370 A1 * 12/2018 Liao ..... A61H 1/00
2019/0029385 A1 * 1/2019 Deeter ..... B62B 3/104
2019/0135490 A1 * 5/2019 Munoz ..... A45F 3/04

* cited by examiner

MASSAGE ROLLER AND CONTAINER

CROSS REFERENCE TO RELATED APPLICATIONS

This application is a non-provisional application which claims priority to U.S. Provisional Application No. 62/954,629 filed on Dec. 29, 2019, which is incorporated by reference in its entirety.

FIELD OF THE DISCLOSURE

This disclosure relates generally to the field of containers and exercise equipment and more particularly for a hollow massage roller and container, which is quick and easy to open and has a carrying apparatus that does not impede with self-myofascial release.

BACKGROUND

Exercise is an important part of a healthy lifestyle and there are a variety of exercise and exercise equipment. One of the more popular pieces of equipment is an exercise mat, which includes yoga mats, sticky mates, and Pilates mats. This piece of equipment tends to be personally owned for hygiene and personal taste reasons and transported to the place of exercise. Another popular piece of exercise equipment is the self-myofascial release tool, more specifically the massage roller or foam roller. The massage roller is used to release muscle tightness or trigger points. Often the two pieces of equipment will be used at or around the same time as a person is exercising.

Currently there are a variety of massage rollers, however they lack a quick and easy closure, a carrying strap system that does not impede the use of the massage roller, and a separate compartment for other items. Thus, there is a need for a hollow massage roller that is a container, which has a quick and easy to use closing mechanism, and a carrying system that does not impede the self-myofascial release process.

SUMMARY

The disclosure herein relates to a container comprising: a hollow component closed at an end and open at a second end, the hollow component configured to receive an exercise mat wherein self-myofascial release material is attached or affixed to the outside of the hollow component, further comprising a lid component attached to the second end of the hollow component, a latch component attached to the lid component wherein a button component attached to the second end of the hollow component is configured to release the latch component, a hollow space in the lid component with a closure component, wherein the hollow space is accessible by unfastening a threaded engagement between the closure component and the lid component, wherein the hollow space is accessible by unfastening a snap fit engagement between the closure component and the lid component, further comprising a circular attachment point attached to the lid component wherein the circular attachment point is used to attach other items to the container, a strap that does not impede the use of the self-myofascial release material, wherein the strap is positionable inside of an indent in the self-myofascial release material, wherein the strap is retractable such that when retracted is positioned inside of the indent.

The present disclosure is also directed to a combination container and roller comprising: a hollow component closed at an end and open at another end, the hollow component configured to receive an exercise mat wherein self-myofascial release material is attached or affixed to the outside of the hollow component, a lid component attached to the open end of the hollow component, a latch component attached to the lid component wherein a button component attached to the open end of the hollow component is configured to release the latch component, and a hollow space in the lid component with a closure component, wherein the hollow space is accessible by unfastening the closure component from the lid component, further comprising a strap which is retractable such that when retracted is positioned inside of an indent in the self-myofascial release material and a circular attachment point attached to the lid component wherein circular attachment point is used to attach other items to the container.

DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
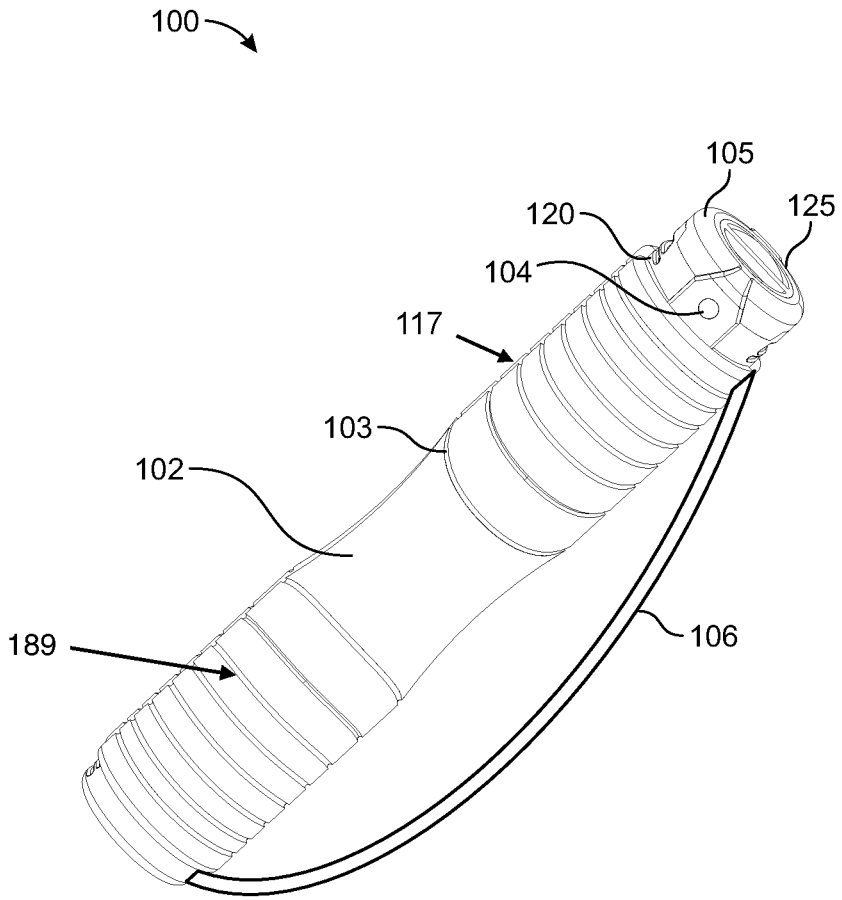
FIG. 1 is a perspective view of an exemplary massage roller exercise mat container according to various aspects of the present disclosure.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises," and grammatical equivalents thereof are used herein to mean that other components, ingredients, steps, among others, are optionally present. For example, an article "comprising" (or "which comprises")

components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure recognizes the unsolved need for a container that is also a massage roller, which has a quick and easy to use closure, and a carrying system that does not impede the self-myofascial release process. The invention is, in one embodiment, a massage roller that is a container with a hinged lid, opened by the press of a button or activator, with straps that are under tension for use in carrying the container.

With reference now to FIG. 1, one exemplary embodiment of a container and massage roller 100, according to the present invention is generally designated. FIG. 1 is a perspective view of container and massage roller 100. The massage roller and container may include a hollow component, closed at one end and open at the other, such as hollow component 103. The hollow component 103 may be made out of plastic, vinyl, PVC, or any other material that would be obvious to one of ordinary skill in the art.

Affixed or attached around hollow component 103 may be material suitable for self-myofascial release 102, including foam, plastic, rubber, or any other material used by those of ordinary skill in the art to allow self-myofascial release. In other embodiments there may be no self-myofascial release material 102. The self-myofascial release material 102 may have any number of designs including one or more ridges 117 for gripping or varied thicknesses for use in self-myofascial release. The self-myofascial release material 102 may have any number of air vents 189 to allow the passage for hot yoga or other activities. Self-myofascial release 102 and hollow component 103 may have a generally hourglass shape including an upper section and a lower section that are connected by a waistline but also may be any other suitable shape, such as a cylinder, depending on the needs of the user.

Figure 3:
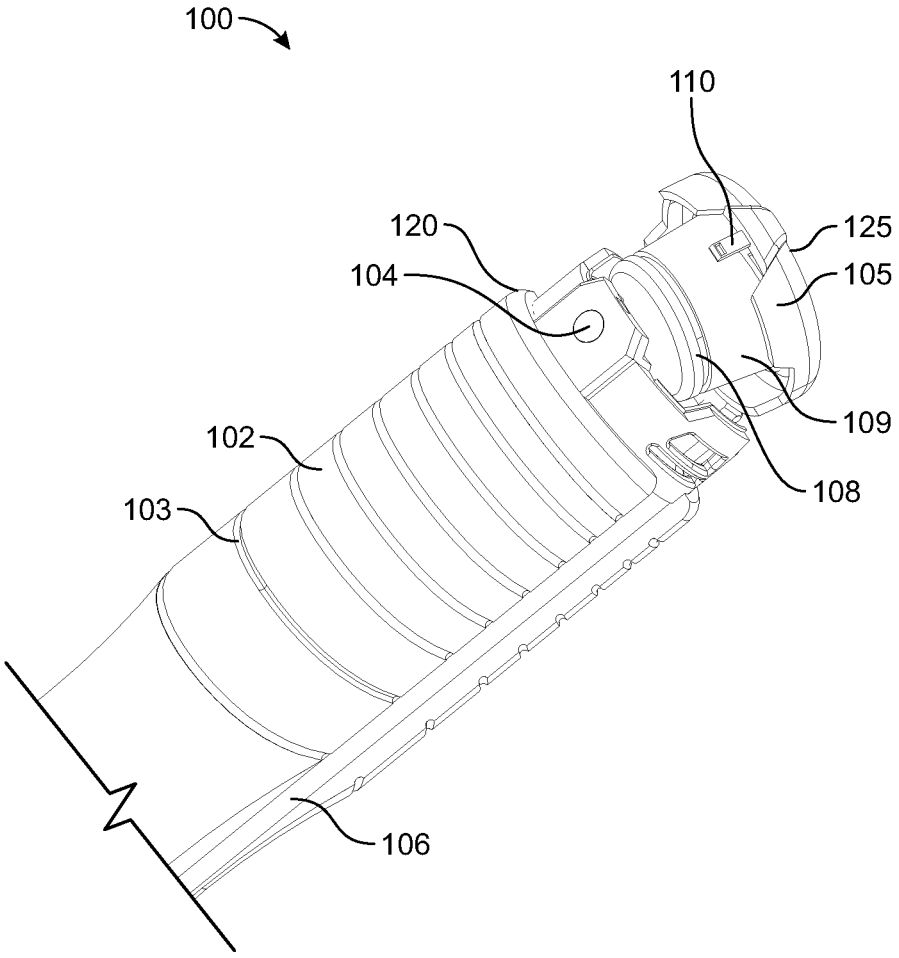
FIG. 3 is a view of the lid of an exemplary massage roller exercise mat container of FIG. 1.
Figure 4:
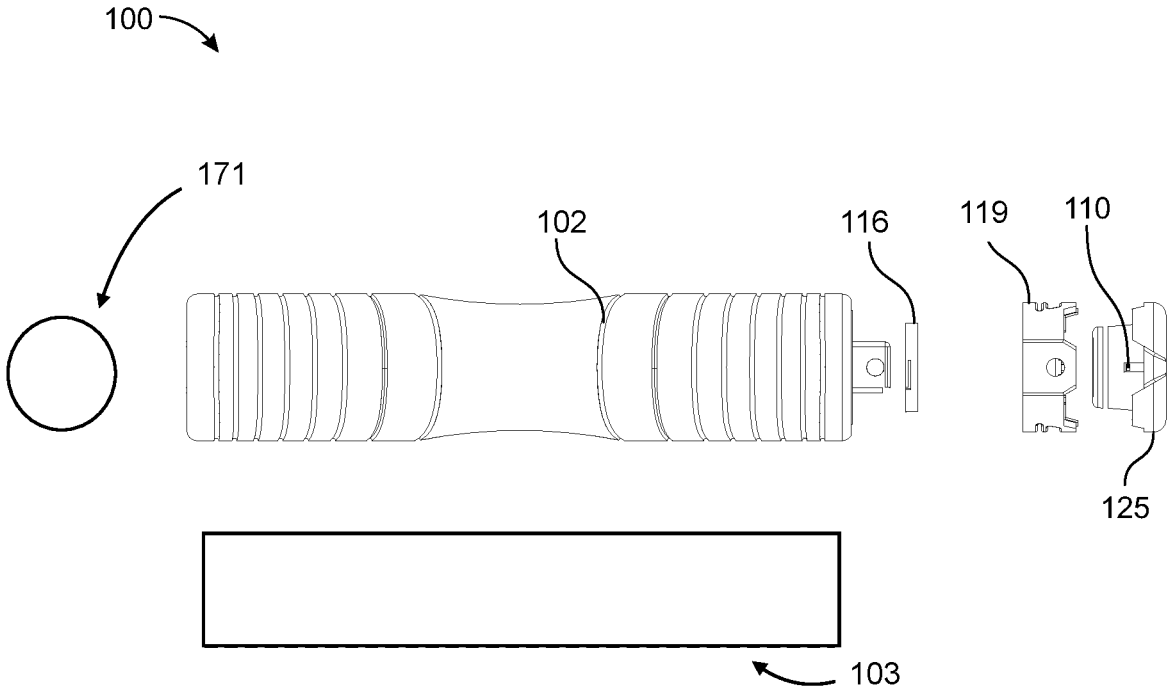
FIG. 4 is an exploded view of the components of an exemplary massage roller exercise mat container of FIG. 1.
Figure 6:
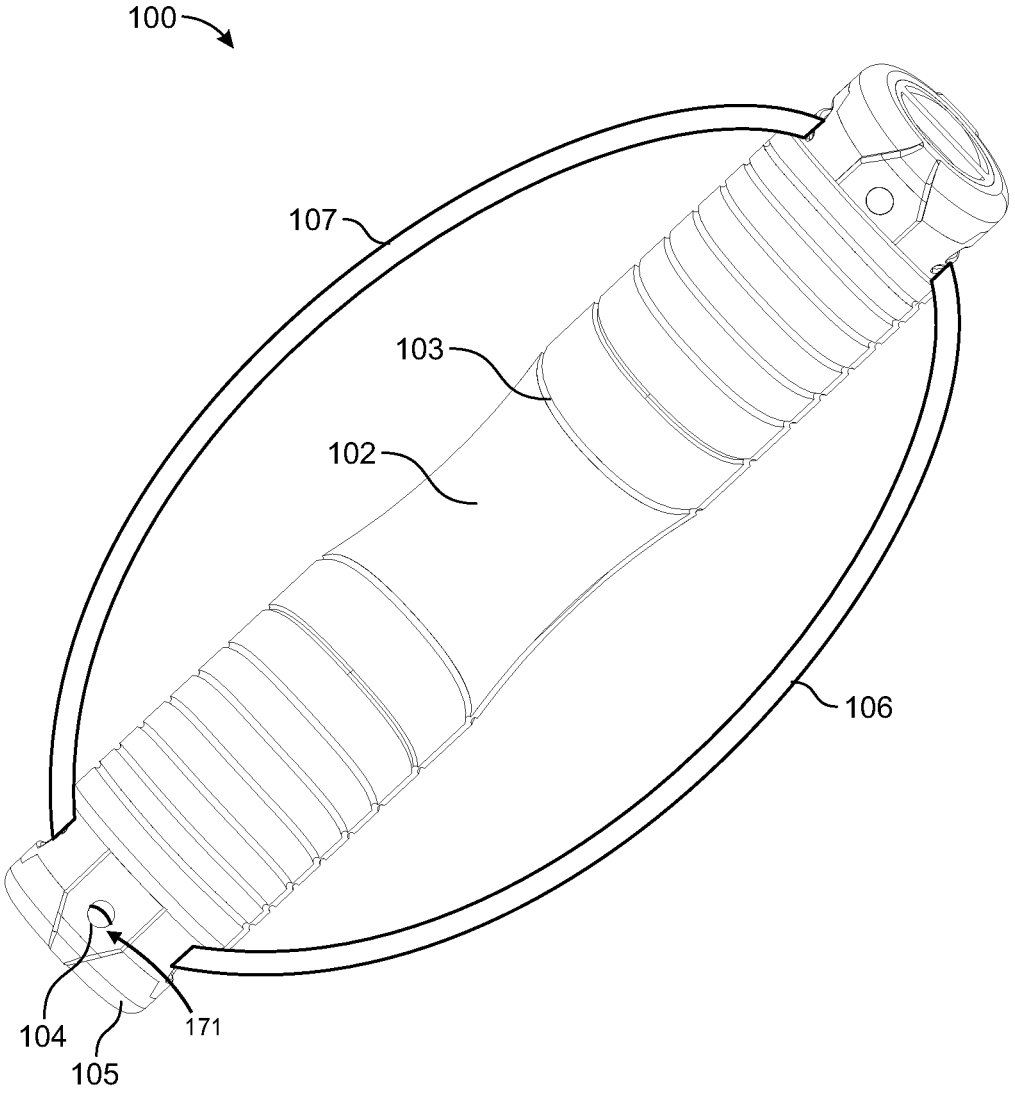
FIG. 6 is another embodiment of massage roller exercise mat container according to various aspects of the present disclosure.

A lid component may be attached to the open end of hollow component 103, such as lid component 105. In one embodiment, lid component 105 is a hinged lid with a bottom surface 108 which can be opened with a button 104 on a receiving portion 119 connected to self-myofascial release material 102 by a connecting component 116 as illustrated in FIG. 4. As illustrated in FIG. 3, the lid component 105 may have a latch 110, which may be released via press of button 104. Lid component 105 may include one or more ridges 120 for gripping or varied thicknesses. In one embodiment, lid component 105 has one or more threads whereby the one or more threads allows lid component 105 to engage with a threaded component of hollow component 103 to stack upon the other and mechanically lock with each other. In this embodiment, lid component 105 may have a silicon overmold to assist with gripping lid component 105 to remove lid component 105 from hollow component 103. As illustrated in FIG. 6, lid components 105 may be attached to hollow component 103 at both ends of self-myofascial release material 102. In some embodiments lid component 105 may instead be connected to a pressure ball or massage roller ball 171 at one end.

Figure 2:
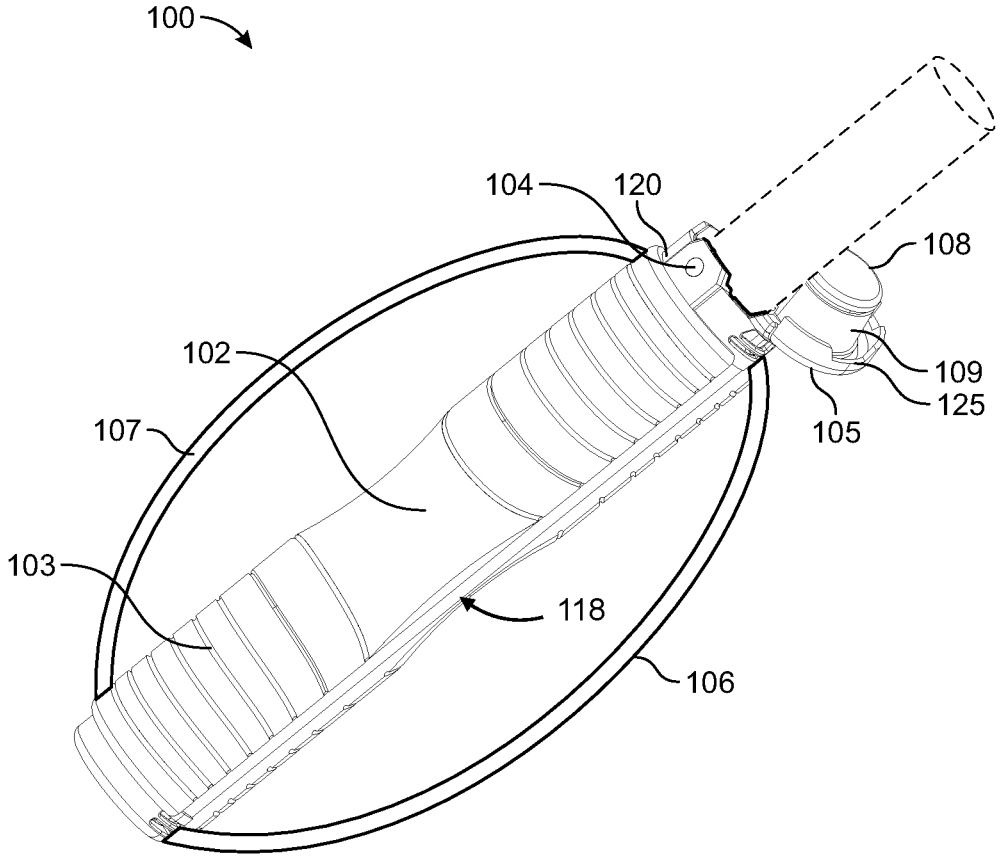
FIG. 2 is another perspective view of an exemplary massage roller exercise mat container of FIG. 1.

In one embodiment, a strap 106 may be attached to hollow component 103 at both the open and closed ends of hollow component 103 wherein strap 106 may be under tension. Strap 106, when not in use, may be retracted and held under tension within an indent 118 positioned inside of the self-myofascial release material. Strap 106 may be detachable and used as a stretching device. Strap may also be any other type of strap suitable for carrying container and massage roller 100. As illustrated in FIG. 2, an additional strap 107 may be attached to the open and closed ends of hollow component 103 and it may be under tension. Inside lid component 105 there may be a hollow space 109 to contain other items. The hollow space may be accessed by a closure 125, which may be a threaded closure or closed by other methods known to one of ordinary skill in the art. In this embodiment, closure 125 may have a silicon overmold to assist with gripping closure 125 to remove closure 125 from lid component 105 to access hollow space 109.

Figure 7:
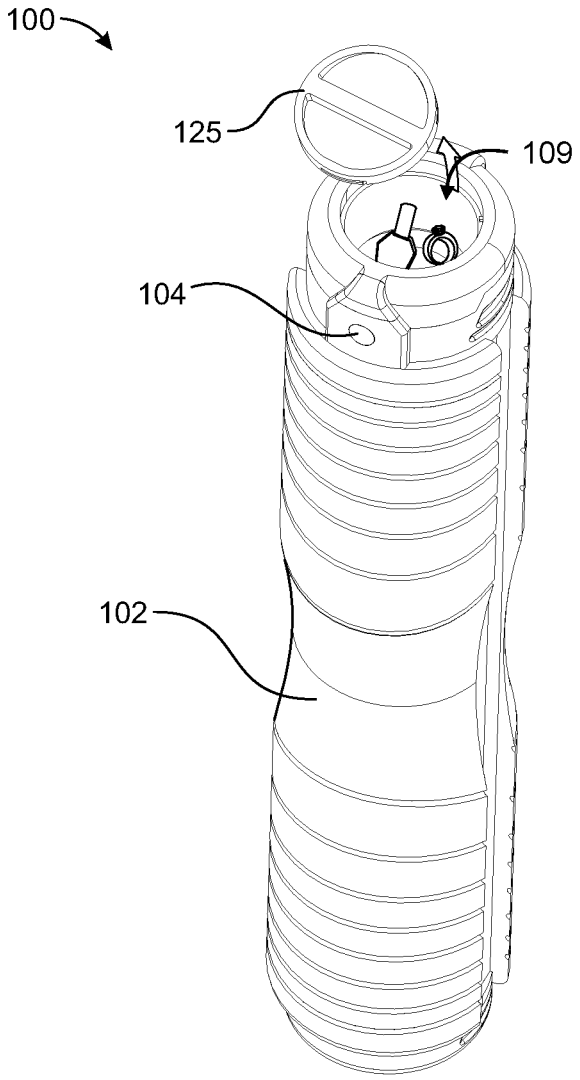
FIG. 7 illustrates the hollow space of the lid that may be accessible to store items.

With reference to FIG. 7, hollow space 109 in the lid component may be accessed by closure 125, using a ninety degree turn closure, a threaded closure, a snap fit closure, or any other closures that would be obvious to one of ordinary skill in the art. The latch component 110 can also be a simple latch that opens without the need or use of a button 104, as well as any other latches that would be obvious to one of ordinary skill in the art.

Figure 5:
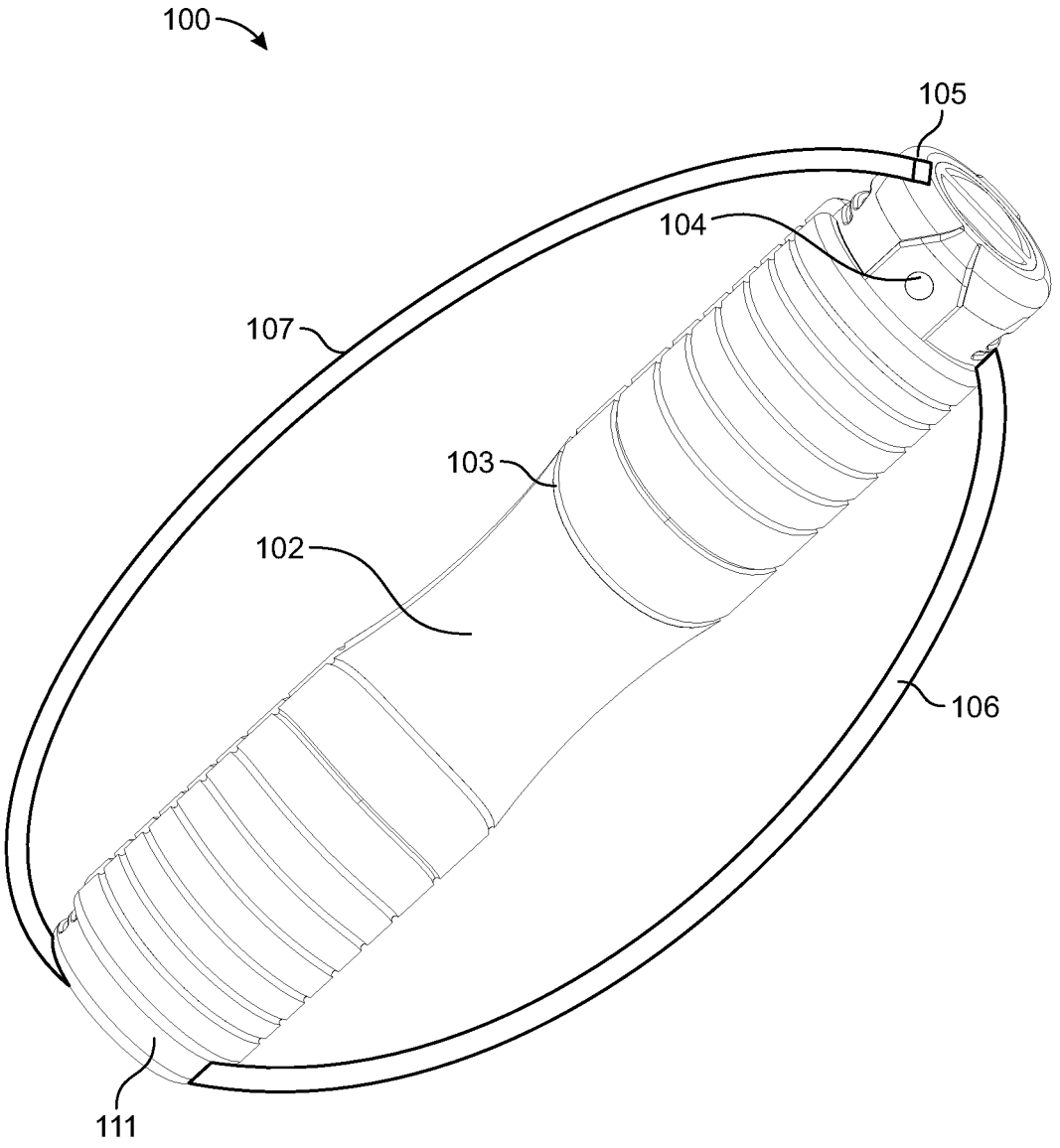
FIG. 5 is another perspective view of an exemplary massage roller exercise mat container.
Figure 8:
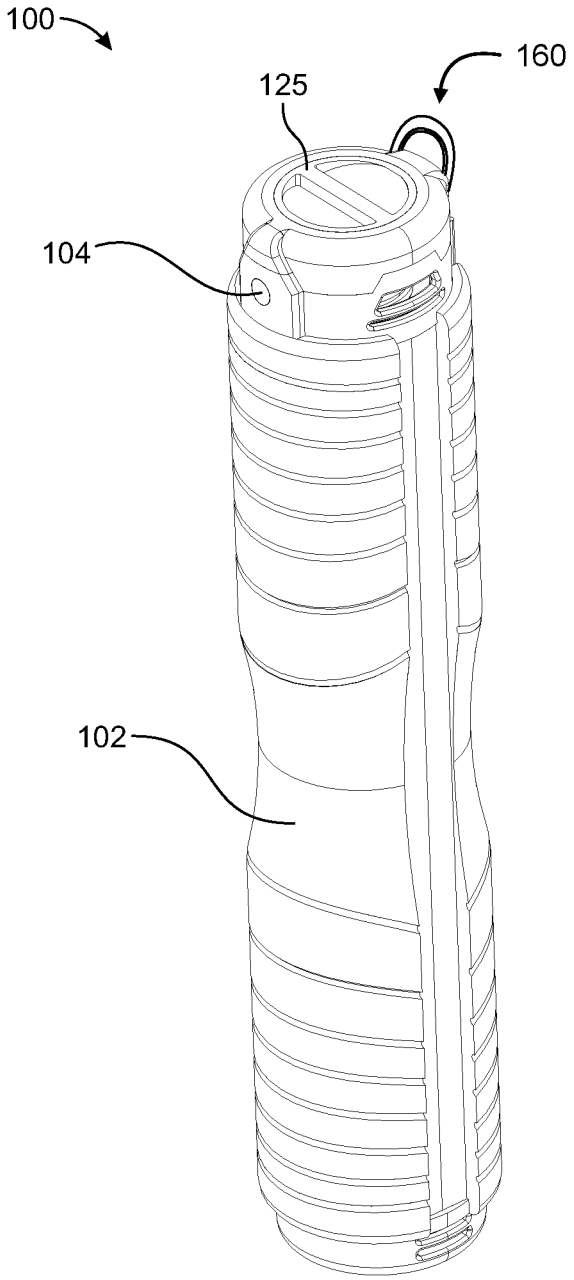
FIG. 8 is another perspective view of an exemplary massage roller exercise mat container with a D-ring.

With reference now to FIG. 5, one exemplary embodiment of the container includes additional means for attaching items to the container. A horizontal strap 111 (horizontal when container and massage roller 100 is being used as a roller), may be wrapped around or attached to self-myofascial release material 102. Alternatively, as discussed horizontal strap 111 may be attached to hollow component 103 and imbedded into self-myofascial release material 102 in an indent 118, recess, or cavity, such that horizontal strap 111 does not protrude from self-myofascial release material 102. Horizontal strap 111 may be utilized to attach other items to the outside of container 100. A circular attachment point 160 may be attached to lid component 105. Circular or D-shaped attachment point 160, as illustrated in FIG. 8 may also be used to attach other items, such as carabineers, as well as allow container 100 to be hung or clipped to other objects for transport or storage. D-shaped attachment point 160 may also be integrated into the shape of lid component 105.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A container comprising: a hollow component closed with a first end and an open second end, the hollow component having a hollow interior for receiving an exercise mat wherein self-myofascial release material is attached or affixed to an outside of the hollow component, the container comprising a lid component attached to the second end of the hollow component, the lid component having a closure component and a storage compartment having an interior for storing one or more items, the storage compartment separate from the hollow interior, wherein the storage component is accessible by unfastening the closure component from the lid component, the storage compartment accessible when the lid component is attached to the second end of the hollow component, wherein the lid component is insertable into the hollow component, the container configured to act as a massage roller.

2. The container of claim 1, further comprising a latch component attached to the lid component wherein a button component attached to the second end of the hollow component releases the latch component such that the exercise mat is accessible when the latch component is released.

3. The container of claim 1, further comprising air vents on the self-myofascial release material to allow passage for hot yoga or other activities.

4. The container of claim 1, further comprising a circular or d-shaped attachment point integrated into the lid component to allow the container to be hung or clipped to other objects for transport or storage.

5. The container of claim 1 wherein the storage compartment is accessible by unfastening a threaded engagement between the closure component and the lid component.

6. The container of claim 5 wherein the closure component has a silicon overmold for gripping.

7. The container of claim 5 wherein the closure component has one or more middle contours for gripping.

8. The container of claim 1, wherein the storage compartment is accessible by unfastening a snap fit engagement between the closure component and the lid component.

9. The container of claim 1, further comprising an attachment point attached to the lid component wherein the attachment point is used to attach other items to the container.

10. The container of claim 1, further comprising a massage ball positioned at the first end of the hollow component.

11. The container of claim 10, further comprising a strap, wherein the self-myofascial release material has a channel for storing the strap, wherein the strap is retractable such that the strap is storable inside of the self-myofascial release material when retracted.

12. The container of claim 11 wherein the strap is detachable to operate as a stretching device.

13. The container of claim 1, wherein the self-myofascial release material has an hourglass shape including an upper section and a lower section that are connected by a waistline.

14. The container of claim 13, wherein the self-myofascial release material has one or more ridges configured to facilitate gripping by a user's body.

15. A combination container and roller comprising: a hollow component having an open first end and an open second end, the hollow component having a hollow interior for receiving an exercise mat wherein self-myofascial release material is attached or affixed to an outside of the hollow component, a first lid component attached to the first end and a second lid component attached to the second end of the hollow component, a latch component attached the first lid component and the second lid component wherein a button component attached to the first end and the second end of the hollow component is configured to release the latch component, the first lid component and the second lid component having a closure component, and a storage compartment for storing one or more items, the storage compartment separate from the hollow interior, wherein the storage component is accessible by unfastening the closure component from the lid, wherein the lid component is insertable into the hollow component, the container configured to act as a massage roller.

16. The container of claim 15 further comprising a strap, wherein the self-myofascial release material has a cavity for storing the strap is retractable such that the strap is storable inside of the self-myofascial release material when retracted.

17. A container comprising: a hollow component and a massage roller surrounding the hollow component, the hollow component closed with a first end and an open second end, the hollow component having a hollow interior for receiving an exercise mat wherein the massage roller is attached or affixed to an outside of the hollow component, the container comprising a lid component attached to the second end of the hollow component, the lid component having a closure component and a storage compartment having an interior for storing one or more items, the storage compartment separate from the hollow interior, wherein the storage component is accessible by unfastening the closure component from the lid component, the storage compartment accessible when the lid component is attached to the second end of the hollow component, wherein the hollow interior is accessible by pivoting the lid component in relation to the hollow component.

* * * * *